United States Patent [19]

Shook

[11] Patent Number: 4,537,639

[45] Date of Patent: Aug. 27, 1985

[54] METHOD FOR CLEANING WELD SMUT FROM A SURFACE

[75] Inventor: Forrest A. Shook, Fenton, Mich.

[73] Assignee: NLB Corp., Wixom, Mich.

[21] Appl. No.: 531,463

[22] Filed: Sep. 12, 1983

[51] Int. Cl.[3] ..... B08B 3/02

[52] U.S. Cl. ..... 134/10; 134/34; 134/39

[58] Field of Search ..... 219/98, 99; 134/10, 134/25.4, 32, 34, 39, 45, 94, 95, 108, 110, 111, 123, 129

[56] References Cited

U.S. PATENT DOCUMENTS

| | | | |
|---|---|---|---|
| 3,409,030 | 11/1968 | Schmidt | 134/123 |
| 3,502,215 | 3/1970 | Cahan | 134/123 X |
| 3,774,625 | 11/1973 | Wiltrout | 134/123 X |
| 4,317,020 | 2/1982 | Shoup | 219/99 X |

*Primary Examiner*—Richard V. Fisher
*Assistant Examiner*—W. Gary Jones
*Attorney, Agent, or Firm*—Cullen, Sloman, Cantor, Grauer, Scott & Rutherford

[57] ABSTRACT

A system for circulating the fluid to and from a jet spray device and a method of cleaning weld smut using the jet spray device having a seal assembly through which a high pressure fluid is transferred to a rotatable tubular shaft having a plurality of tubular arms for spraying the fluid toward the base of a stud. The seal assembly includes a jacket having a cylindrical bore closed and sealed on first and second ends by front and rear end plates and annular sealing rings. An annular spring is mounted on a tubular shaft between first and second sets of annular sealing rings to urge said first and second sets of sealing rings into engagement with the front and rear end plates respectively. The annular spring permits fluid to flow from a fluid supply hose through a fitting formed in the jacket to the tubular shaft. A motor is provided for rotating the tubular shaft within the cylindrical bore and the tubular arms rotate about the stud.

5 Claims, 4 Drawing Figures

METHOD FOR CLEANING WELD SMUT FROM A SURFACE

BACKGROUND OF THE INVENTION

The present invention relates to an apparatus and method for cleaning weld smut from the base of an object and a surface to which the object is welded. More specifically, the present invention relates to such an apparatus and method wherein fluid is sprayed toward a zone of concentration from a plurality of spaced nozzles. The nozzles are attached to tubular arms which are attached to a tubular shaft that is rotated by a motor to assure complete cleaning of weld smut from object and the surface.

In the manufacture of automobiles and other articles of manufacture studs are welded to a metal surface prior to painting to facilitate attaching trim pieces after painting. Frequently, the studs have a t-shaped cross-section wherein the top of the tee is welded to the metal surface with the upright portion of the tee extending outwardly from the surface. The studs are resistance welded to the surface by passing electric current through the studs and the surface until the stud is fused to the surface.

A carbon or dirt deposit, commonly referred to as weld smut, may be deposited on the stud and in a ring around the stud on the surface during the resistance welding operation. The weld smut will interfere with the adhesion of the paint if the weld smut is not completely removed from the metal surface prior to the final metal finishing and painting operation. Eventually, rust tends to develop around the studs because the paint can be loosened from the surface.

To assure a quality product it is important to remove the weld smut prior to painting operations. Prior art methods of removing weld smut include manually brushing or wiping the weld smut from the surface of the object and weld stud. When this method is used it is difficult to completely remove the weld smut due to the difficulty of cleaning close to the base of the stud. Frequently, a large number of studs are attached to an object at regular intervals which makes the job of cleaning weld smut both tedious and difficult. The labor expense of removing the weld smut is significant and attempts to automate the process of cleaning weld smut have heretofore been ineffective.

These and other problems have been overcome by the method and apparatus of the present invention.

SUMMARY OF THE INVENTION

The present invention relates to a method and apparatus for thoroughly cleaning weld smut from a stud and the surface surrounding the stud by focusing the high pressure spray from a plurality of nozzles which rotate about the stud. The apparatus has a plurality of tubular arms that are supplied with pressurized fluid from a rotatable tubular shaft.

According to the one feature of the present invention, a unique seal assembly permits the fluid to be supplied to the rotatable tubular shaft intermediate its length through a jacket which substantially encloses the tubular shaft. A plurality of annular sealing rings form a seal between the tubular shaft and the cylindrical bore of the jacket on opposite sides of the fitting through which the fluid is introduced into the seal assembly. An annular spring is provided within the seal assembly between two sets of the sealing rings for holding the annular sealing rings in place. The annular spring permits fluid to pass from the fitting to a plurality of openings formed in the tubular shaft.

The openings in the rotatable tubular shaft are preferably located adjacent to the annular spring and the opening in the jacket. The annular sealing rings prevent any fluid from escaping from the seal assembly through the ends of the jacket.

The tubular shaft is preferably rotated by means of a hydraulic or pneumatic motor which is aligned coaxially with the central axis of the tubular shaft. This arrangement is simple, lightweight and inexpensive making it ideal for use on automated production lines. The present invention is particularly well suited for use with a mechanical arm, or robot, which is effective to move the apparatus between predetermined locations or according to sensed location of the studs.

The system for circulating the fluid, preferably water or an aqueous solvent solution, is a high pressure closed loop system having means for filtering and heating the fluid. A no load start up fluid circuit is provided to facilitate starting the system and provision is made for adding water periodically to make up for evaporation and other loss of fluid.

These and other advantages realized by the method and apparatus of the present invention will be better appreciated upon study of the following specification and claims in conjunction with the appended drawings.

DETAILED DESCRIPTION OF THE INVENTION

Figure 1:
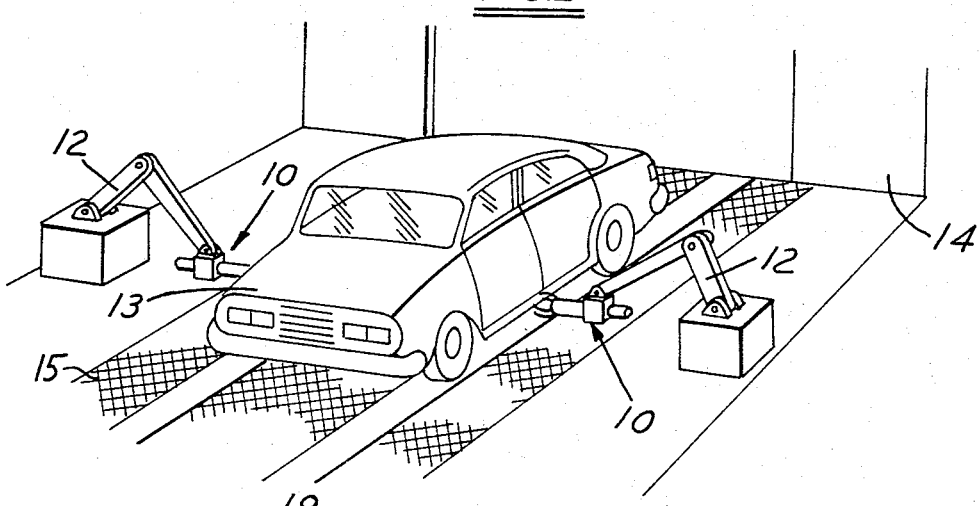
FIG. 1 is a fragmentary perspective view of a spray booth having two robot arms with the cleaning apparatus of the present invention cleaning weld smut from a vehicle.

Referring now to the drawings, in FIG. 1 the apparatus for cleaning weld smut from a surface having a stud welded thereto is generally indicated by reference numeral 10. The apparatus 10 is attached to and moved by a mechanical arm 12 for cleaning weld smut from various locations on an automobile body 13. The apparatus is generally used within a spray booth 14 having a floor grating 15 through which fluid draining from the apparatus 10 may be removed from the spray booth 14.

Figure 2:
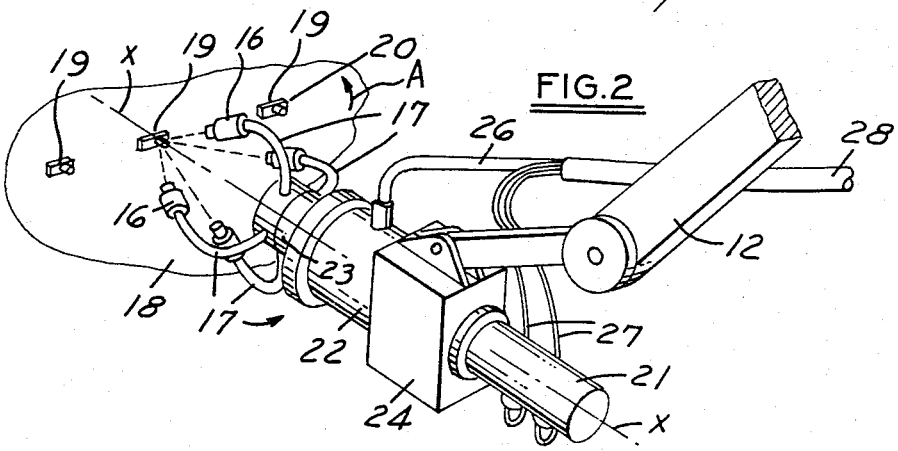
FIG. 2 is a fragmentary perspective view of the cleaning apparatus of the present invention cleaning weld smut from a t-stud and a portion of a panel.

Referring now to FIG. 2, the apparatus 10 is shown attached to one end of a mechanical arm 12. The apparatus 10 features a plurality of nozzles 16 which are each connected to a tubular arm 17 to direct a fluid spray toward a surface 18 having t-studs 19 welded thereon to remove weld smut 20 from both the surface 18 and the t-stud 19. The nozzles 16 are effective to direct the flow of fluid toward a zone of concentration about the base of the t-stud 19 to assure complete removal of weld smut 20.

A motor 21, being either a hydraulic or pneumatic motor, is attached to the apparatus 10 in line with the central axis for rotating the tubular arms 17 and nozzles 16 about the central axis as shown by directional arrows A in FIG. 2. The apparatus 10 includes a seal assembly 22 which substantially encloses a tubular shaft 23 through which water is supplied to the tubular arms 17 and nozzles 16. The apparatus 10 is secured to the mechanical arm 12 by means of a bracket 24 which holds the motor 21 and seal assembly 22 stationary as the tubular shaft 23 is rotated.

Pressurized fluid is supplied to the seal assembly 22 through a hose 26 which is connected to the seal assembly 22 at a location intermediate the length of the seal assembly. The fluid is pressurized by a pump which is connected to the system, as will be more fully described with reference to FIG. 4, below. It has been determined that fluid pressure of between 100 and 10,000 pounds per square inch may be supplied to the apparatus 10 with acceptable cleaning action. Generally, if an aqueous cleaning solution is used, fluid pressures of 5,000 psi or less may be used. In one test, an aqueous cleaning solution supplied to the apparatus at 2,000 psi achieved good cleaning results. If substantially pure water is used as the fluid, higher pressures on the order of 5,000 to 10,000 psi may be required.

Hydraulic fluid is supplied to the motor 21 through the tubing 27 to drive the motor 21, as is well known in the art.

Figure 3:
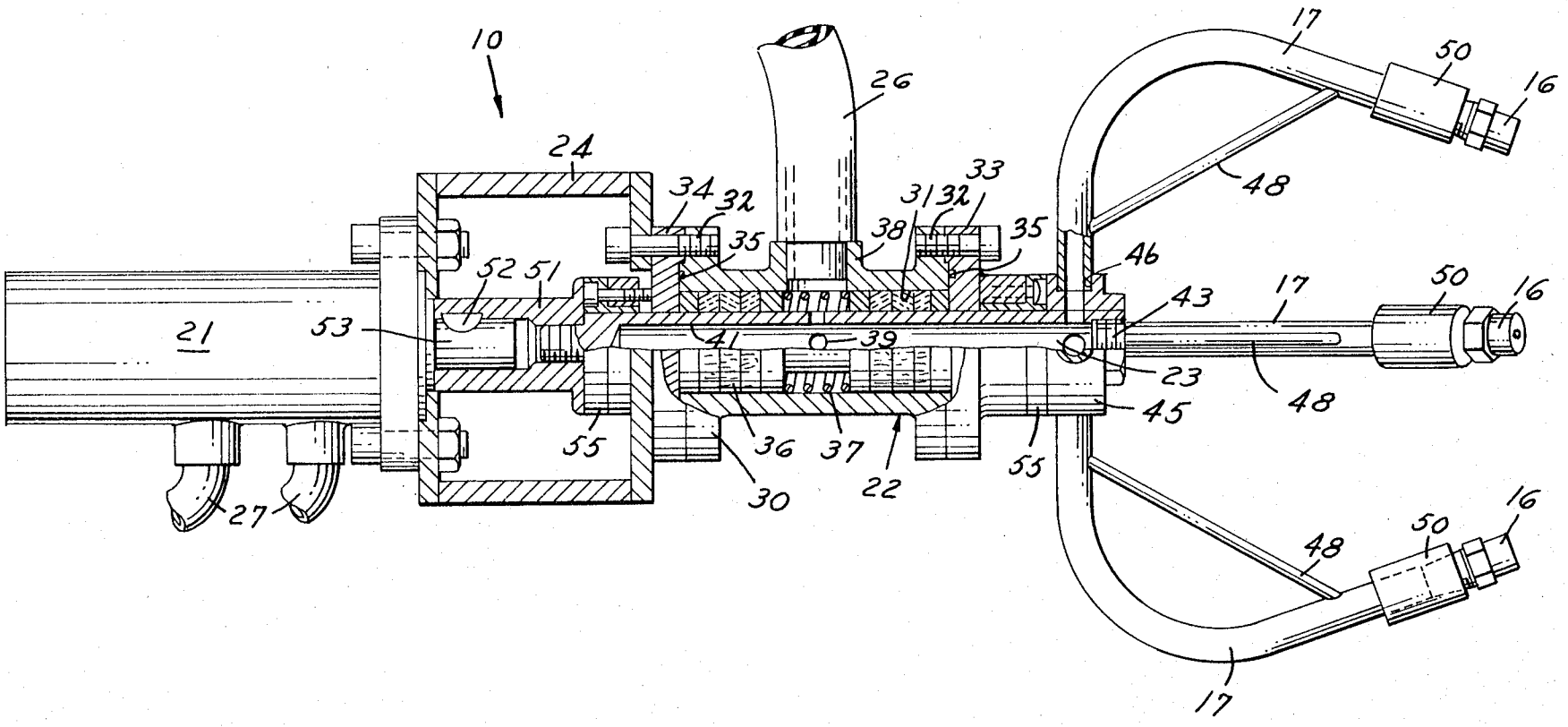
FIG. 3 is a partial cross-sectional view of the cleaning apparatus of the present invention.

Referring to FIG. 3, the seal assembly 22 includes a jacket 30 comprising a generally cylindrical member having a cylindrical bore 31 formed therein and being substantially enclosed on opposite ends by front and rear end plates 33 and 34. The end plates 33 and 34 are secured to opposite ends of the jacket 30 by mechanical fasteners 32 and is sealed by an O-ring 35 which are disposed between the front and rear end plates 33 and 34 and the jacket 30. A plurality of annular ring seals 36 are provided between the tubular shaft 23 and the cylindrical bore 31 of the jacket 30 to prevent any fluid from escaping through the space between the jacket 30 and tubular shaft 23. The annular ring seals 36 are separated into a front set and a back set by an annular spring 37. Annular spring 37 holds the sets of annular ring seals 36 in place within the cylindrical bore 31 by exerting a biasing force outwardly toward the front and rear end plates 33 and 34. The annular spring 37 has spaces between adjacent coils to permit fluid to pass axially through the annular spring 37.

The annular ring seals 36 are preferably formed of different materials with hard plastic rings being included in each set adjacent the annular spring 37 and the front and rear end plates 33 and 34 to assure the durability of the packing assembly. The remaining annular ring seals are formed of a packing material chosen for its sealing characteristics.

A fitting 38 is formed on or secured to the jacket 30 of the seal assembly 22 for receiving the hose 26. Fluid is supplied from the hose 26 to the cylindrical bore 31 between the two groups of annular ring seals 36 and in alignment with the annular spring 37.

Openings 39 are formed through the tubular shaft 23 adjacent the annular spring 37 for permitting the pressurized fluid to flow into the tubular shaft 23. Preferably four openings are formed in the tubular shaft 23. The area surrounding the annular spring 37 acts as a fluid reservoir surrounding the tubular shaft 23. The tubular shaft 23 has a cylindrical cavity 41 comprising a blind bore having a closed end on one end and a plug 43 welded in the opposite end for closing the cylindrical cavity near the tubular arms-17. A distributor block 45 is secured to the front end of the tubular shaft 23. The distributor block 45 has a plurality of holes 46 formed therein at spaced axial locations for receiving the tubular arms 17. As the apparatus is operated, water is permitted to flow into the tubular shaft 23, as previously described, through the openings 39 and out of the cylindrical cavity 41 of the tubular shaft through the holes 46 in the distributor block 45 into the tubular arms 17 to be sprayed through the nozzle 16.

The tubular arms 17 extend radially from the distributor block 45, as shown in FIGS. 2 and 3, and are curved back toward the central axis x of the apparatus 10 at an acute angle. The tubular arms 17 are reinforced by means of a reinforcement rod 48 which holds the tubular arm-17 in its proper orientation. A fitting 50 is provided on the end of the tubular arm 17 to which the nozzles 16 are attached.

It should be readily understood that the tubular shaft 23, tubular arms 17 and nozzles 16 are all mounted for rotation about the central axis by the motor 21. The tubular shaft 23 is attached to a retainer 51 by screw threads, a spline connection or otherwise. The retainer 51 is secured to the motor 21 by means of a key 52 which holds the retainer 51 on a rotating shaft 53 of the motor 21. The key 52 is provided to permit assembly and disassembly of the motor 21 to the tubular shaft 23 and retainer 51 if it becomes necessary to repair or replace the motor 21. Bearings 55 are provided on opposite ends of the seal assembly 22 to facilitate rotation of the tubular shaft 23 within the seal assembly 22.

Figure 4:
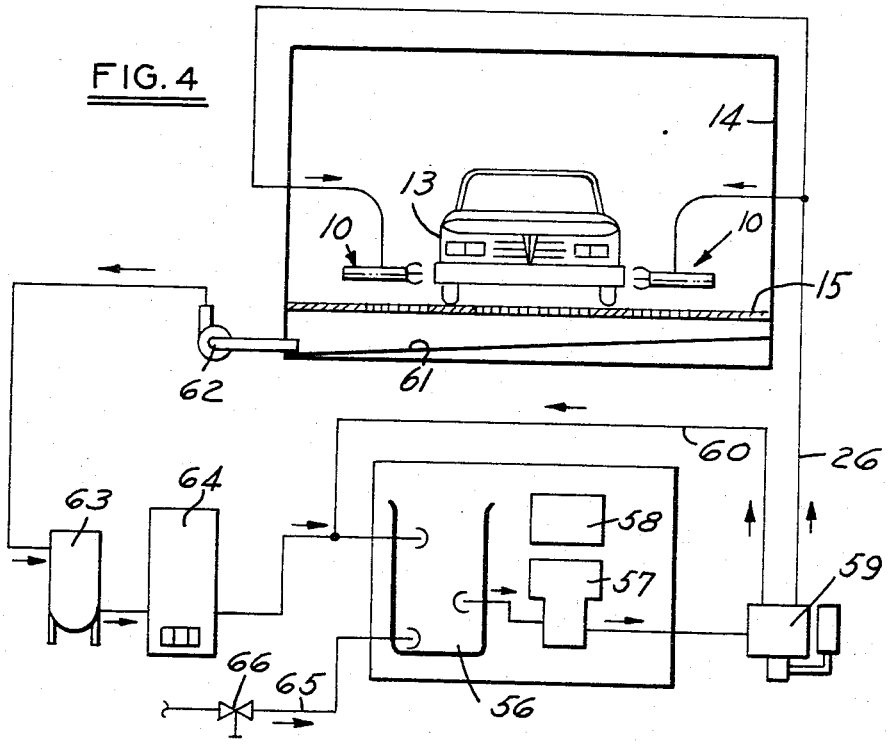
FIG. 4 is a schematic diagram of the water recirculating system used to supply water to the cleaning apparatus of the present invention.

Referring now to FIG. 4, the fluid circuit of the present invention is shown diagramatically. A tank 56 contains the fluid which is sprayed onto the t-stud 19 and surface 18 to remove weld smut 20. The fluid is withdrawn from the tank 56 by a high pressure pump 57 which is driven by an electric motor 58.

The fluid is displaced from the high pressure pump 57 to a valve 59 which has a normal position wherein the fluid is permitted to flow through the apparatus 10 and a start up position wherein the fluid is routed through a fluid circuit 60 which returns the fluid to the tank 56. The fluid circuit 60 is provided to reduce the load on the pump 57 when the system is started.

In its operative position, the valve 59 directs water through the hose 26 or other piping to the apparatus 10 where the fluid is directed through the nozzles 16 to the surface 18 and t-stud 19 from which the weld smut 20 is to be removed. The fluid drains off of the automobile 13 or other object, through the floor grating 15 to a subfloor 61 which is preferably slanted or otherwise drained to a return pump 62. Return pump 62 removes the water from the subfloor 61 and pumps it to a filter 63 which removes impurities from the fluid. After cleaning, the fluid is heated to a predetermined temperature by a heater 64, preferably a water heater, before being returned to the tank 56. The heater 64 may be omitted from the system completely if a cold fluid spray would be effective in a particular application or the heater may be included in the system and used only as needed.

In normal operation, the fluid evaporates or the supply is otherwise diminished. Make up water is supplied to the tank 56 by means of make up piping 65 which includes a fill valve 66.

In operation, the high pressure pump 57 withdraws water from the tank 56 and directs it through the hose 26 to the apparatus 10. The fluid is forced through the fittings 38 and annular spring 37 into the openings 39 formed in the tubular shaft 23. The fluid is thereby admitted into the cylindrical cavity 41 and forced through the cylindrical cavity into the distributor block 45 which supplies water to the tubular arms 17. The fluid is then forced through the nozzles 16 to remove weld smut 20 from the t-stud 19 and surface 18 by a turbulent scrubbing action.

The apparatus is moved into position by the robot, or mechanical arm 12, so that it is directed at a t-stud 19. The mechanical arm 12 moves to various locations on the automobile body 13 according to programmed instructions that correspond to locations where weld smut 20 is likely to be present. Alternatively, the mechanical arm 12 can be controlled by optical scanning or other sensing devices. As shown in FIG. 1, two mechanical arms 12 are provided with one arm on each side of the vehicle, however, if required, more than one mechanical arm 12 may be provided on each side.

While the present invention has been disclosed with reference to a preferred embodiment, it is to be understood that the invention is not limited to the above embodiment. Many alternatives, modifications and variations will be apparent to those skilled in the art in light of the foregoing description. Accordingly, the invention is to be construed to embrace all such alternatives, modifications and variations that are within the spirit and scope of the following claims.

I claim:

1. A method for cleaning weld smut from a surface having studs welded thereto with a jet spray device having a plurality of rotatable tubular arms radially spaced from the stud directed to a zone of concentration on the surface comprising the steps of:

aiming the jet spray device at one of the studs so that the tubular arms are inwardly directed at a zone of concentration spaced radially from the base of the stud and said tubular arms are encircling the stud;

directing a fluid under high pressure through the tubular arms and spraying the high pressure fluid against said zone of concentration; and, rotating said tubular arms about the stud during said spraying step to spinningly focus said spray in a narrow band of surface area at said zone of concentration.

2. The method of claim 1, further comprising the step of collecting and filtering the fluid after the fluid is sprayed on the surface.

3. The method of claim 1 comprising the further step of heating said fluid.

4. The method of claim 1, including the step of pumping the fluid to the tubular arms under pressure of between 100 and 10,000 pounds of pressure per square inch.

5. The method of claim 1, wherein said tubular arms are directed at the base of the stud from a distance of about six inches.

* * * * *